US005673916A

United States Patent [19]

Horan

[11] Patent Number: 5,673,916

[45] Date of Patent: Oct. 7, 1997

[54] MATRIX GAME INCORPORATING DICE OR OTHER RANDOM ELEMENT GENERATOR

[76] Inventor: Michael J. Horan, 6109 St. Marie, Pittsburgh, Pa. 15206

[21] Appl. No.: 308,373

[22] Filed: Sep. 19, 1994

[51] Int. Cl.[6] ..... A63F 1/00

[52] U.S. Cl. ..... 273/269; 273/274

[58] Field of Search ..... 273/146, 269, 273/270, 274, 271, 292, 309

[56] References Cited

U.S. PATENT DOCUMENTS 3,549,150 12/1970 Weeks ..... 273/269

3,690,668 9/1972 Weeks et al. ..... 273/269

5,308,081 5/1994 Bartle ..... 273/274

5,362,064 11/1994 Lofink et al. ..... 273/274

*Primary Examiner*—William M. Pierce

*Attorney, Agent, or Firm*—Daniel J. Long

[57] ABSTRACT

A game played on a matrix like bingo in which a first player or a first plurality of players are associated with a first matrix, and a second player or a second plurality of players is associated with a second matrix. Dice or other random element generators are used to generate sets of elements which the players match on the matrices. The generation of random sets of elements continues until a matching set of elements or a predetermined number of matching sets of elements is produced on one of the matrices.

25 Claims, 2 Drawing Sheets

MATRIX GAME INCORPORATING DICE OR OTHER RANDOM ELEMENT GENERATOR

BACKGROUND OF THE INVENTION

1. Field of the Invention

The present invention relates to games and, more particularly, to bingo and games similar to bingo.

2. Brief Description of the Prior Art

Games such as bingo are played on a matrix comprising an array of elements arranged in columns and rows. A corresponding form of the elements is individually drawn at random by a "caller," and players "cover" the drawn elements with markers on one or more matrices. The game ends when one or more winners are declared when the first player or plurality of players cover a predesignated pattern or set of elements on the winning player or players' matrix or matrices. The elements may be either numbers, letters, or any of a variety of symbols.

Classic bingo, as the game is commonly played, incorporates constituent letters of the word "BINGO" in the heading of the columns of a 5-column matrix, which also typically has five rows. Seventy-five numbers (five sets of fifteen) are assigned to the constituent letters of the word "BINGO" (B-1 through B-15, I-16 through I-30, N-31 through N-45, G-46 through G-60 and O-61 through O-75). Players select one or more matrices bearing predesignated sets of letter-number elements (five elements in each column, except the "N" column where the third element, being the center element in the array, is always designated by the word "Free"). Because only five of fifteen possible letter-number elements under each of the constituent letters of the word "BINGO" are designated on any matrix (four in the "N" column), there are thousands of possible sets of letter-number elements in each array before any set repeats itself.

Traditionally, a bingo "caller" randomly draws individual objects inscribed with a single letter-number (called "pills") and announces the letter-number element so drawn. Players use a "marker" to "cover" the number called under the associated letter on "cards" which they have selected prior the commencement of play. Combinations or patterns of elements thus covered by the players determine a winner or winners of the game. Traditional winning combinations or patterns are determined by the operator of the game and include covering all of the elements in a single column or row, the numbers at each of the four corners of a card, and all of the numbers on a card.

Electronic and mechanical embodiments of traditional bingo have substantially changed the method of playing the game. Rather than drawing "pills" from a container, mechanical devices have been employed to shake or spin the pills and randomly eject one at a time. Mechanical bingo "blowers" are employed to eject individually and randomly balls inscribed with the classic bingo letter-number combinations. More recently, electronic random number generators have been devised to generate the bingo letter-number combinations. And most recently, bingo "cards" have given way to individual cathode-ray tubes (screens) which display matrices from which the bingo player may select and "cover" electronically-generated letter-number combinations by using a keypad, or a touch-sensitive screen. Bingo is even played by means of an interactive, electronic satellite communications link where thousands of players in hundreds of locations may participate in a game "called" electronically. Notwithstanding the technological advances in the embodiment of the classic version of bingo, letter-number combinations are still commonly referred to as "drawn," the method of announcing or displaying the drawn letter-number combinations as "called" by a "Caller," and the method of marking called letter-number combinations as "covered."

Although classic bingo is a widely played and popular game, many players might enjoy a faster game with additional functions that could be performed by the players themselves and allow them to be more active participants. There is, therefore, a need for a game that, although similar to bingo, is faster and allows the players a more active role in the game.

As bingo is conventionally played, it is purely a game of chance where the players wager on the outcome by purchasing bingo cards against the chance that they will win a prize established by the organizer, generally consisting of cash. The organizer of the game (referred to for the purpose of this description as the "House") is exposed to some risk on wagers placed, so that traditional bingo is a game "banked" by the House rather than a parimutuel game. For regulatory or other reasons, such banking games may be undesirable or prohibited, and a need exists for a game similar to bingo that is not a banking game.

SUMMARY OF THE INVENTION

In a basic form of the game of the present invention, a first player or a first group of players is associated with a first matrix. A second player or a second group of players is associated with a second matrix. There are no more than two different matrices, but there may be any number of either, each of which is associated with an individual player.

Each matrix has at least two columns of elements and at least two, and preferably four, rows of elements, although there may be more than four. The two matrices will have the same number of columns and the same number of rows. Preferably the relationship between the number of columns and the number of rows may be expressed as when there is an n number of columns there preferably will be a 2n number of rows, where n is any positive integer. Alternatively, when there is an n number of columns there will be an n+2 number of rows. It will be appreciated, however, that the foregoing relationships are only preferred and that a large variety of other possible relationships between the number of columns and rows would be possible within the scope of the present invention.

As with classic bingo, each element is located in one column and one row. The elements on each of the two matrices are arranged into predesignated sets, which will usually be the set of elements in adjacent columns in common rows. No predesignated set of elements on one matrix will ever duplicate the predesignated set of elements on the other matrix. Preferably, the elements will be the letters "B", "I", "N" "G" "O", and the word "FREE," although other letters, integers or symbolic elements may be substituted therefor.

A random element generator, such as dice, is used to generate a random set of elements. The number of elements generated should be equal to the number of columns in the individual matrices. If the randomly-generated set of elements matches any predesignated set on either the first matrix or the second matrix, the player or players associated with the matrix or matrices on which the matching set is contained is declared to be a winner. If no match is made on either matrix, the random element generator (or dice) is again employed to generate another random set of elements, until a winning match occurs on one of the matrices. In variations of the game, two or more matching sets may be required to occur on the same matrix before a winner is declared.

BRIEF DESCRIPTION OF THE DRAWINGS

The invention is further described with reference to the accompanying drawings in which.

DETAILED DESCRIPTION OF THE PREFERRED EMBODIMENT

A preferred embodiment of the game of the present invention incorporates the name and letters B-I-N-G-O and the symbol FREE which are used as elements to determine winning combinations in the game.

Figure 1:
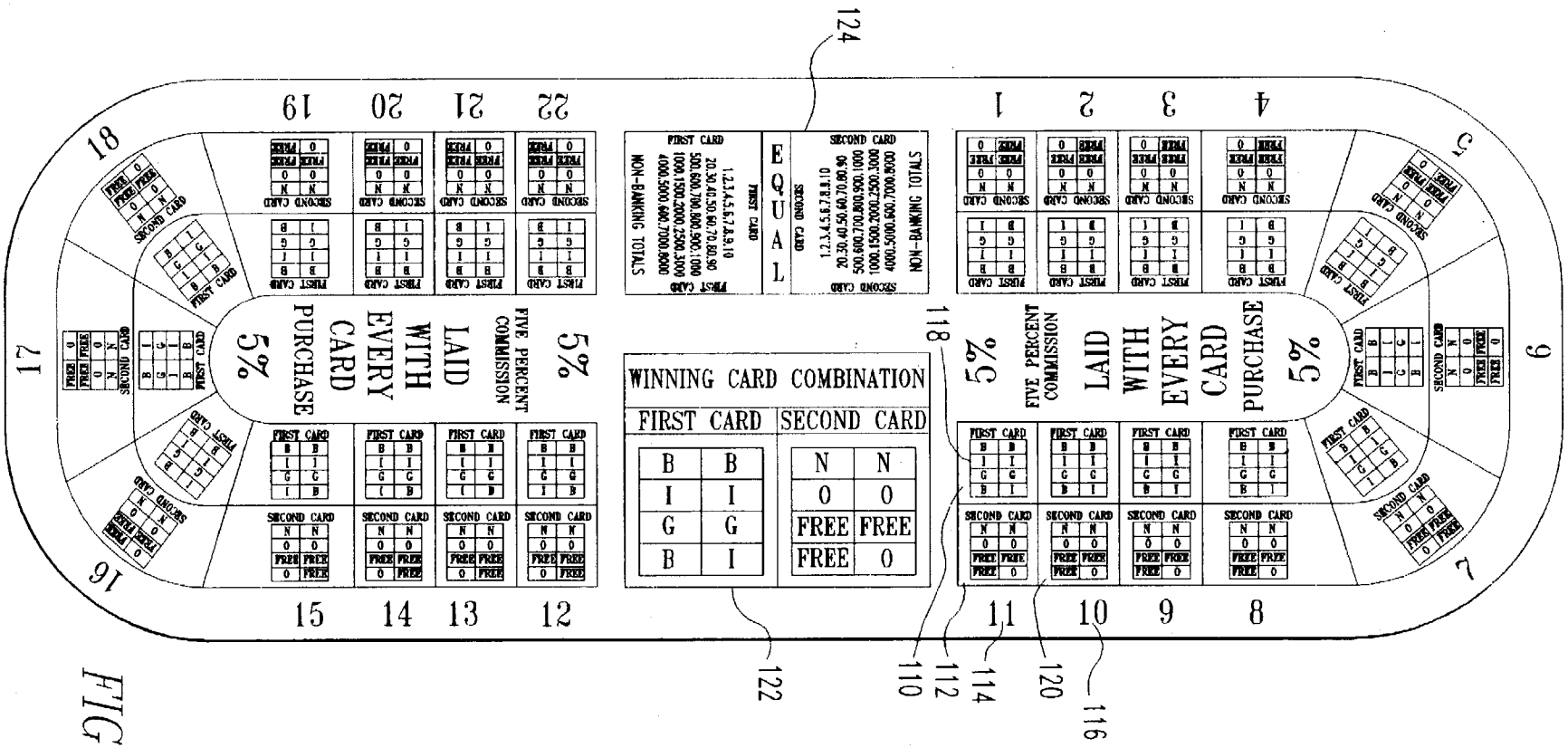
FIG. 1 is a plan view of a surface on which a preferred embodiment of the present invention may be played.
Figure 2:
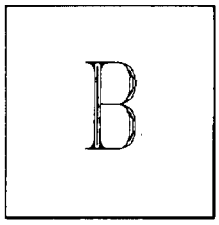
FIGS. 2–7 are side elevation views of the various faces of a die used to randomly generate elements in a preferred embodiment of the game of the present invention.
Figure 3:
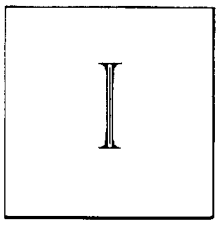
Figure 4:
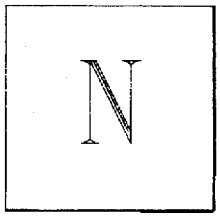
Figure 5:
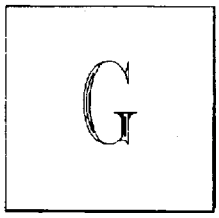
Figure 6:
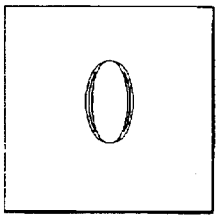
Figure 7:
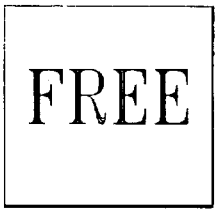

Referring to FIG. 1, the game makes use of two matrices as at 110 and 112 for each player position as at 114 and 116. For the purpose of this description, the two matrices are referred to individually as the "First Card" and "Second Card," and collectively as "Cards." The two Cards display the predesignated sets of elements that determine a winner or winners. Achieving a matching set of elements on the First Card or the Second Card is called a "Bingo."

Adjacent to each Card, there is a space as at 118 and 120 where chips or other tokens may be placed by a player to indicate the player's wager on that Card. A large version of each of the two Cards comprises the official scorecards 122 are maintained by the operator who, for the purpose of this description, is referred to as the "Caller." A calculator board 124 is also used by the caller or an assistant to calculate wagers made on each of the two Cards.

Referring to FIGS. 2–7, the random-element generator consists of two special, insigniated dice that substitute on each die the five letters "B-I-N-G-O" and the word "FREE" for the six dotted numbers on a conventional set of dice. The letters "B-I-N-G-O" and "Free" comprise the six elements of the predesignated sets on the Cards. For the purpose of this description, the player designated to roll the dice is referred to as the "Shooter."

The Caller is the supervising authority whose decision is final on all matters that arise during the game.

The game begins by the Caller designating one player as the Shooter. If there has been an immediately preceding game, the Shooter will be the player who: (a) last rolled the dice and achieved a "Bingo" on the Card on which the Shooter placed his wager; or (b) the first player clockwise of the last Shooter willing to roll the dice, where the Shooter declines to roll the dice again; or (c) the first player clockwise of the last Shooter where the last Shooter failed to achieve a "Bingo" on the Card on which the Shooter placed his wager.

The Shooter so designated strikes a wager by placing chips or tokens in the space adjacent to either the First Card or the Second Card at his position, but never both. Going clockwise (with reference to the plan view of the playing surface in FIG. 1), each player sequentially strikes a wager on either the First Card or the Second Card until all wagers have been struck. All wagers must be within limits posted by the operator of the game that, for the purpose of this description, is referred to as the "House." No side wagers are allowed. The Caller or his assistant calculates the total of wagers placed on all of the First Cards and all of the Second Cards, which must be equal (faded) to insure that the House has not banked the game. The Caller may fade the wagers either by announcing that the game has not been faded and urging players to modify their wagers, either in amount or by switching wagers from one Card to the other, or by designating a player to act as a "fader" to make a wager in such an amount and on such a Card as will balance the wagers on all of the First Cards and all of the Second Cards. In designating a "fader," the Caller may offer a discounted commission to induce the "fader's" participation in that capacity. When the wagers have been faded, the Caller declares the game "closed," after which no wagers may be changed and no additional wagers may be placed.

Each wager on either the First Card or the Second Card requires a commission to be laid with the wager. The commission may be a flat fee, or a percentage of the wager (preferably from 1% to 10% of the wager). The commission is earned by the House for the operation of the game, but is only collected on losing wagers. Alternatively, it may be collected on all wagers.

Upon the Caller declaring the game to be "closed," the Shooter rolls the dice to the opposite side of the table, past the Caller, causing both dice to bank off a rail (not shown) (which would surround the playing surface in a preferred embodiment such as depicted in FIG. 1). Alternatively, the dice may be contained in a dice cage (where in a preferred embodiment such as depicted in FIG. 1 the playing surface would not be surrounded by a rail). If the dice are contained in a dice cage, the Shooter tumbles the dice cage one turn. Alternatively, the Caller may turn the dice cage. Whether rolled by a player, or turned in a dice cage, when the dice come to rest the upward surfaces represent the "drawn" set of elements.

If the drawn set of elements matches any of the predesignated sets of elements contained on either the First Card or the Second Card, the players use markers to "cover" those elements on the corresponding Card on which each player placed his or her wager, and declare a "Bingo." The Caller confirms the "Bingo" by covering the matching set of elements on the official scorecard at the Caller's position, while halting the game.

Upon declaring a "Bingo," the Caller and/or his assistant moves the chips or tokens from the space adjacent to all "losing" cards to the center of the playing field, and from the pool thereby created they pay to each "winning" player an amount equal to that player's wager. The remaining chips or tokens, representing the aggregate commission laid with all "losing" wagers, are retained by the House. Alternatively, the commissions laid on "winning" wagers are also collected and retained by the House.

If the drawn set of elements fails to match any of the predesignated sets of elements on either the First Card or the Second Card, the Shooter retains the dice and repeats the process until the drawn set of elements matches one of the predesignated sets of elements on either the First Card or the Second Card. Alternatively, the Shooter or the Caller turns the dice cage one turn until a matching set of elements has been drawn.

In the preferred embodiment, at least three combinations of sets of elements may be predesignated as winning combinations in different games. First, the two-element combinations consisting of adjacent elements in each row on either the First Card and the Second Card, referred to as "Single Line" bingo for the purpose of this description. Second, both of the two-element combinations consisting of adjacent elements in the top and bottom row on either the First Card or the Second Card, consisting of the four corners of either Card, referred to as "Corner" bingo for the purpose of this description. Third, all of the two-element combinations consisting of adjacent elements in every row on either the First Card or the Second Card, consisting of all elements of either Card, referred to as "Cover All" bingo for the purpose of this description.

The method of the present invention is further described with reference to the following examples.

EXAMPLE 1

The House designates the game being played as "Single Line" bingo and has posted a house limit on wagers of $10. The commission required to be laid with each wager is 5% of the wager. The elements will be generated by dice as in FIG. 2–7. The Players will roll the dice, and the playing surface has a rail to allow banking of the dice. The playing surface of the game will be as shown in FIG. 1. The game is operated by a Caller and an assistant. With reference to FIG. 1, the Caller is stationed at the position facing the large First Card and Second Card, and the assistant is stationed directly across the table facing the calculator board. Players are stationed at each of the 22 player positions shown in FIG. 1.

The Caller may designate any player to be the Shooter, but in this Example 1 the Caller designates the player at player position No. 1 (Player No. 1) to be the Shooter. Player No. 1 places a chip purchased from the House for $10 in the space adjacent to the First Card together with a chip purchased from the House for $.50, representing the required commission. The remaining 22 players place chips adjacent to Cards as follows:

| Player Number | Wager | Commission | Card |
|---|---|---|---|
| 2 | $10 | $.50 | 1 |
| 3 | $5 | $.25 | 1 |
| 4 | $5 | $.25 | 2 |
| 5 | $10 | $.50 | 2 |
| 6 | $10 | $.50 | 2 |
| 7 | $10 | $.50 | 2 |
| 8 | $10 | $.50 | 1 |
| 9 | $10 | $.25 | 2 |
| 10 | $5 | $.25 | 1 |
| 11 | $10 | $.50 | 1 |
| 12 | $10 | $.50 | 2 |
| 13 | $10 | $.50 | 1 |
| 14 | $5 | $.25 | 1 |
| 15 | $10 | $.50 | 2 |
| 16 | $10 | $.50 | 1 |
| 17 | $5 | $.25 | 2 |
| 18 | $10 | $.50 | 2 |
| 19 | $10 | $.50 | 1 |
| 20 | $10 | $.50 | 2 |
| 21 | $10 | $.50 | 1 |
| 22 | $5 | $.25 | 2 |

As each wager is placed, the assistant places tokens on the calculator board marking the total amount wagered on the First Card and the total amount wagered on the Second Card, and when Player No. 22 strikes his wager, the calculator board shows that the total of the wagers struck on the First Card and the Second Card balance. The Caller declares the game "Closed."

The Caller passes the dice to the Shooter who throws the dice to the far side of the table past the Caller to the area of Player Nos. 16, 17 and 18. The dice bank off the rail and when they come to rest the upper surfaces read I-N. Since the I-N set fails to match any set of adjacent elements in any row of either the First Card or the Second Card, the Caller declares "No Dice" and returns the dice to the Shooter to roll again. The Shooter rolls the dice in the same manner. When the dice come to rest the upper surfaces read N-N, which set of elements matches the adjacent set of elements, N-N, on the first line of the Second Card. The players who placed their wagers on the Second Card declare "Bingo" while placing markers (covering) on the set of elements, N-N, on the first line of the Second Card at each of their positions.

The Caller also observes the drawn N-N set of elements and places markers on the N-N set of elements on the official Second Card at his position, officially declares a "Bingo," and halts the game.

The assistant removes the chips from each First Card to the center of the playing surface and the Caller and the assistant uses the pool of chips thereby created to pay to each player who wagered on the Second Card an amount equal to that player's wager as set forth above. The remaining chips represent the 5% commissions laid by the players who wagered on the First Card, and those chips are moved to a position in front of the Caller, to be retained by the House.

Since the Shooter failed to throw a set of elements that matched the First Card on which he had placed his own wager, the Shooter must pass the dice to Player No. 2. If Player No. 2 is willing to roll the dice, he becomes the Shooter and the process of striking wagers begins again. If Player No. 2 is unwilling to roll the dice, the dice are passed clockwise from player to player until a player is willing to roll the dice, whereupon that player becomes the Shooter. If the Shooter had thrown a set of elements which had achieved a Bingo on the First Card, he would continue to be the Shooter unless he declined to roll the dice, in which case the dice would be passed in the same manner as if the Shooter had rolled a Bingo on the Card on which he had not placed a wager.

EXAMPLE 2

Continuing the situation described in Example 1, the players strike the following wagers:

| Player Number | Wager | Commission | Card |
|---|---|---|---|
| 1 | $10 | $.50 | 1 |
| 2 | $10 | $.50 | 1 |
| 3 | $5 | $.25 | 1 |
| 4 | $5 | $.25 | 2 |
| 5 | $10 | $.50 | 2 |
| 6 | $10 | $.50 | 2 |
| 7 | $10 | $.50 | 2 |
| 8 | $10 | $.50 | 1 |
| 9 | $5 | $.25 | 2 |
| 10 | $5 | $.25 | 1 |
| 11 | $10 | $.50 | 1 |
| 12 | $10 | $.50 | 2 |
| 13 | $10 | $.50 | 1 |
| 14 | $5 | $.25 | 1 |
| 15 | $10 | $.50 | 2 |
| 16 | $10 | $.50 | 1 |
| 17 | $5 | $.25 | 2 |
| 18 | $10 | $.50 | 2 |
| 19 | $10 | $.50 | 1 |
| 20 | $10 | $.50 | 2 |
| 21 | $10 | $.50 | 1 |
| 22 | $5 | $.25 | 2 |

The assistant determines and the Caller confirms that the total of wagers struck on all of the First Cards does not equal the total of the wagers struck on all of the Second Cards. The Caller announces that the wagers are not "faded," and announces that "we need $5 more placed on the Second Card." In response, Player No. 9 increases his wager to $10 and lays an additional $.25 commission, and the Caller declares the game "Closed." The game then proceeds as in Example 1.

EXAMPLE 3

Continuing the situation described in Example 1, except that the House has designated the game to be played as "Corners" bingo.

After the Shooter rolls the N-N set of elements, all of the players who have wagered on the Second Card cover the N-N set of elements on the Second Card at each of their player positions. The Caller passes the dice back to the Shooter who rolls the dice again. When the dice come to rest, the upper surfaces read I-I. Because the I-I set appears on the First Card, but does not "cover" any corners, the Dealer calls "No Dice" and passes the dice back to the Shooter. The Shooter rolls the dice again. When the dice come to rest, the upper surfaces read FREE-0. The Players who wagered on the Second Card cover the FREE-0 set of elements on the Second Cards at each of their player positions and declare "Bingo." The Dealer also observes the FREE-0 set or elements, covers the FREE-O set of elements on his official Second Card, and confirms a Bingo. The game then proceeds as in Example 1.

It will be appreciated that the game of the present invention has been described in which the matrix is referred to as a card. As in classic bingo, the term "card" is intended to include paper media, tabletops, electronically-displayed matrices, and the like. Similarly, the method of generating random sets of elements is intended to include electrically-activated, mechanical dice "shakers," electronic random element generators, and the like. The game of the present invention may also be played on a playing surface where one or more, or any combination, of the constituent elements shown in FIG. 1 consists of a mechanical or electrical device, such as (a) cathode-ray tubes or screens in place of individual cards at each playing position (including the official scorecards at the Caller's position) which generate and display the matrices and other game information, such as the amounts wagered and sets of elements drawn; (b) keypads or buttons at each playing position by means of which wagers are placed; (c) a button at each playing station that electrically activates a mechanical dice "shaker," or random element generator instead of dice cubes; and/or (d) an electronic calculator or similar data processor that records, adds and displays total wagers placed on all of the First Cards and all of the Second Cards.

It will be appreciated that the game may be further facilitated electronically in a manner such that it may be played without any common playing surface at all and in many different configurations, including those where the players are removed from one another and/or from the Caller and are joined by an interactive electrical link, or electronic communications link, such as satellite, or combinations of both.

While the present invention has been described in connection with the preferred embodiments of the various elements, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of playing a game comprising the steps of:

(a) providing a first matrix having an array consisting of at least two columns of elements and at least two rows of elements, said columns and rows being arranged such that each of said elements is simultaneously included in one of said columns and one of said rows and is positioned adjacent to at least one of said elements so as to form primary predesignated sets of elements each of the elements in said primary predesignated sets being adjacent to at least one other of said elements in its said set;

(b) providing a second matrix having an array consisting of at least two columns of elements and at least two rows of elements, said columns and rows being arranged such that each of said elements is simultaneously included in one of said columns and one of said rows and is positioned adjacent to at least one of said elements so as to form secondary predesignated sets of elements, each of the elements in said secondary predesignated sets being adjacent to at least one other of said elements in its said set;

(c) causing a first player to be associated by a physical means with said first matrix by having said first player assigned to a first position adjacent said first matrix;

(d) causing a second player to be associated by a physical means with said second matrix by having said second player assigned to a second position adjacent said second matrix; and (e) generating a random set of elements and declaring a winning combination if said random set of elements matches any one of the primary predesignated sets of elements or any of the secondary predesignated sets of elements and wherein if the random set of elements generated in this step does not match either any one of the primary predesignated sets of elements or any one of the secondary predesignated sets of elements, further random sets of elements are successively randomly generated until one of said further random sets of elements matches either any one of the primary predesignated sets of elements or any one of the secondary predesignated set of elements, and the first player wins when one of said random sets of elements matches any one of the primary predesignated sets of elements and the second player wins when one of said random sets of elements matches any one of the second predesignated sets of elements and the first player is included in a first plurality of players all of which play the first matrix and each of said first plurality of players wins when one of said random sets of elements matches any one of the primary predesignated sets of elements and the second player is included within a second plurality of players all of which play the second matrix and each of said second plurality of players wins when one of said random sets of elements matches any one of the secondary predesignated set of elements and wagers are made and a total amount is wagered by both the first plurality of players and the second plurality of players and the total amount wagered by the first plurality of players equals the total amount wagered by the second plurality of players.

2. The method of claim 1 wherein if the random set of elements generated in step (e) does not match either any of the primary predesignated set of elements or any one of the secondary predesignated set of elements, further random sets of elements are successively randomly generated until one of said further random sets of elements matches either any one of the primary predesignated set of elements or any one of the secondary predesignated set of elements.

3. The method of claim 1 wherein the number of players in the first plurality of players is equal to the number of players in the second plurality of players.

4. The method of claim 3 wherein both the first matrix and the second matrix are positioned before each player in both the first plurality of players and the second plurality of players.

5. The method of claim 1 wherein an operator controls the game and there are winning wagers and losing wagers and a fixed percentage of all losing wagers is paid to said operator.

6. The method of claim 5 wherein the fixed percentage of all losing wagers paid to the operator is from about 1% to about 10%.

7. The method of claim 1 wherein an operator controls the game and there are wagers and a fixed percentage of all wagers is paid to said operator.

8. The method of claim 7 wherein the fixed percentage of all wagers paid to the operator is from about 1% to about 10%.

9. The method of claim 8 wherein there are four rows including a top row and a bottom row.

10. The method of claim 9 wherein the game is played until there is a matching set of elements on more than one of said rows.

11. The method of claim 10 wherein the game is played until there is a matching set of elements on the top row and the bottom row of either the first card or the second card.

12. The method of claim 10 wherein the game is played until there is a matching set of elements on all of the rows of either the first card or the second card.

13. The method of claim 10 wherein the random sets of elements are generated by means of dice.

14. The method of claim 1 wherein the operator is paid for a card purchase by all players.

15. The method of claim 1 wherein the first card and the second card both have two columns of elements and the primary sets of elements and the secondary sets of elements comprise pairs of elements in each of said columns in common rows.

16. The method of claim 15 wherein the random set of elements comprises two elements.

17. The method of claim 1 wherein the elements are integers.

18. The method of claim 17 wherein the elements are integers from and including 1 through 6.

19. The method of claim 1 wherein the elements comprise the letters "B", "I", "N", "G", "O", and the word "FREE".

20. The method of claim 19 wherein each of the elements is on one face of each of two die.

21. The method of claim 1 wherein all elements in the random set of elements are simultaneously generated.

22. The method of claim 1 wherein the number of elements in the random set generated is step (e) is equal to the number of columns in both the first matrix and the second matrix.

23. The method of claim 1 wherein in both the first matrix and the second matrix there is an n number of columns and a 2n number of rows.

24. The method of claim 1 wherein in both the first matrix and the second matrix there is an n number of columns and an n+2 number of rows.

25. The method of claim 1 wherein the number of rows in the first matrix equals the number of columns in the first matrix and the number of rows in the second matrix equals the number of columns in the second matrix.

* * * * *